US011167435B2

(12) United States Patent
Elling et al.

(10) Patent No.: US 11,167,435 B2
(45) Date of Patent: Nov. 9, 2021

(54) LATCHLESS LOCKING MECHANISM FOR BUTTERFLY KNIFE

(71) Applicant: Benchmade Knife Co., Inc., Oregon City, OR (US)

(72) Inventors: Samuel Elling, Oregon City, OR (US); Mark Delplanche, Beavercreek, OR (US); Hans Albing, Portland, OR (US); Jason France, Gladstone, OR (US); Ryan Dickman, Sandy, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 0 days.

(21) Appl. No.: 16/712,980

(22) Filed: Dec. 12, 2019

(65) Prior Publication Data

US 2020/0189128 A1 Jun. 18, 2020

Related U.S. Application Data

(60) Provisional application No. 62/779,412, filed on Dec. 13, 2018.

(51) Int. Cl.
*B26B 1/10* (2006.01)
*B26B 1/04* (2006.01)

(52) U.S. Cl.
CPC . *B26B 1/10* (2013.01); *B26B 1/04* (2013.01)

(58) Field of Classification Search
CPC .... B26B 1/00; B26B 1/02; B26B 1/04; B26B 1/10; B25G 3/38
USPC ..... 30/153; 7/118; 81/427.5, 177.6
See application file for complete search history.

(56) References Cited

U.S. PATENT DOCUMENTS 19,606 A * 3/1858 Henn ..... B26B 5/00 7/118
229,706 A * 7/1880 Jansen ..... B26B 1/02 30/153
333,466 A * 12/1885 Hunter ..... B26B 11/001 30/157
881,294 A * 3/1908 Billings ..... B26B 1/02 30/153
1,665,955 A * 4/1928 Gatewood ..... B26B 1/04 30/153

(Continued)

FOREIGN PATENT DOCUMENTS

DE 201 00 488 U1 * 1/2001 ..... B26B 1/02
KR 1020080034416 A 4/2008
TW 201521980 A 1/2016

*Primary Examiner* — Evan H MacFarlane
(74) *Attorney, Agent, or Firm* — Schwabe Williamson & Wyatt, P.C.

(57) ABSTRACT

A knife having a latchless locking mechanism having a handle half with a left handle portion and a right handle portion held apart to form a blade groove. The left handle portion and the right handle portion each include a liner including a pivot slot and a first lock pin disposed between the first left handle portion and the first right handle portion. A blade having a tang that is pivotally and slidably coupled to the handle half with a pivot pin, the tang including a tang slot configured to accept the locking pin and a hook portion extending over the tang slot, the hook portion configured to capture the lock pin when the blade is in a locked position and thereby prevent rotation of the blade from the first locked position to the open position. A latchless locking system is also provided.

20 Claims, 11 Drawing Sheets

(56) References Cited

U.S. PATENT DOCUMENTS 2,924,879 A * 2/1960 Kraus, Jr. ..... B26B 1/04 30/151
4,330,937 A * 5/1982 Cope ..... A22C 25/006 30/153
4,364,174 A * 12/1982 De Asis ..... B26B 1/10 30/153
4,547,965 A * 10/1985 Moore ..... B26B 1/04 30/153
4,555,822 A * 12/1985 Miceli ..... B26B 1/04 30/153
4,648,145 A * 3/1987 Miceli ..... B26B 11/003 30/153
4,669,140 A * 6/1987 Miceli ..... B26B 1/00 30/153
4,672,743 A * 6/1987 Grahm ..... B26B 1/00 30/153
4,722,140 A * 2/1988 Miceli ..... B26B 1/02 30/153
4,961,239 A * 10/1990 Boyd, Sr. ..... B26B 1/048 7/118
6,195,898 B1 * 3/2001 Lemisch ..... B26B 1/04 30/153
6,282,997 B1 * 9/2001 Frazer ..... B25F 1/003 7/128
6,550,142 B1 * 4/2003 Moser ..... B26B 3/06 30/153
6,715,208 B2 * 4/2004 Lemisch ..... B26B 1/04 30/153
6,848,183 B2 * 2/2005 Lemisch ..... B26B 1/04 30/153
7,581,321 B2 * 9/2009 Kain ..... B26B 1/048 30/153
7,676,930 B1 * 3/2010 Demko ..... B26B 1/04 30/153
8,182,166 B2 * 5/2012 Colman ..... B43K 23/08 401/131
8,393,069 B2 * 3/2013 Glesser ..... B43K 25/00 29/527.1
8,528,215 B2 * 9/2013 Elsener ..... B26B 29/02 30/157
8,601,699 B2 * 12/2013 Vellekamp ..... B26B 1/02 30/155
8,973,273 B2 * 3/2015 Brown ..... B25G 3/38 30/167
D728,856 S * 5/2015 Wang ..... D28/23
9,751,221 B1 * 9/2017 Aylsworth ..... B26B 1/04
D854,393 S * 7/2019 Saunders ..... D8/99
10,377,047 B2 * 8/2019 Janovicz ..... B26B 1/04
2006/0096035 A1 * 5/2006 Ocklenburg ..... B67B 7/44 7/155
2006/0260138 A1 11/2006 VanHoy
2008/0083118 A1 4/2008 Steigerwalt et al.
2012/0102688 A1 5/2012 Yang
2016/0368155 A1 * 12/2016 Mandeville ..... B26B 1/04
2017/0266821 A1 * 9/2017 Cheng ..... B25G 3/16
2018/0178398 A1 6/2018 Janovicz et al.
2019/0344457 A1 * 11/2019 Hunt ..... B26B 1/046

* cited by examiner

LATCHLESS LOCKING MECHANISM FOR BUTTERFLY KNIFE

CROSS-REFERENCE TO RELATED APPLICATION

This application claims the priority benefit of the earlier filing date of U.S. Provisional Application No. 62/779,412, filed Dec. 13, 2018, which is hereby incorporated herein by reference in its entirety.

TECHNICAL FIELD

The present disclosure relates to mechanisms to lock the blade of a knife in a closed position, such as a butterfly style knife, for example, a BALI-SONG® knife.

BACKGROUND

A butterfly style knife is a conventional and very traditional knife that has ancient origins and which is greatly appreciated by knife enthusiasts. Described generally, a butterfly style knife, such as sold under the tradename BALI-SONG® by the BENCHMADE knife company, has a single blade that is pivotally attached to two separate handle pieces at two separate pivot points located on opposite sides of a tang portion of the knife blade. These knives have a fully closed position in which the two handle halves are rotated over the blade so that the blade is fully stowed between (and at least partially within) the opposed handles. In this position, the sharp edge of the blade, or sharp edges if both sides of the blade are sharpened, is safely retained in one or both of the handles. These knives also have a fully open position. In the fully open position, the two handle halves have been rotated 180 degrees from the fully closed position so that the blade extends away from the now-paired handle halves into a position ready for use. In this position the two handle halves are oriented parallel to one another and the user grasps both handle halves at once to define a unitary handle. The two pivot points or pivot axes between the blade and the two handle halves hold the blade in a rigid working position relative to the handle.

The foregoing basic description of a butterfly style knife, such as a BALI-SONG® knife, is useful to describe some of the features of these knives that aficionados of the knives enjoy. Specifically, butterfly style knives, such as a BALI-SONG® knife, are used to perform a variety of elaborate "moves" in which the user flips the blade from closed to open positions, from open to closed, and numerous positions in between. These elaborate techniques are well-known to knife users and have a long history borne out of use of butterfly style knives, such as a BALI-SONG® knives, for defensive, combat and ceremonial purposes. There are many videos showing BALI-SONG® techniques on online video channels such as YouTube and they are instructive on how these knives are used.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
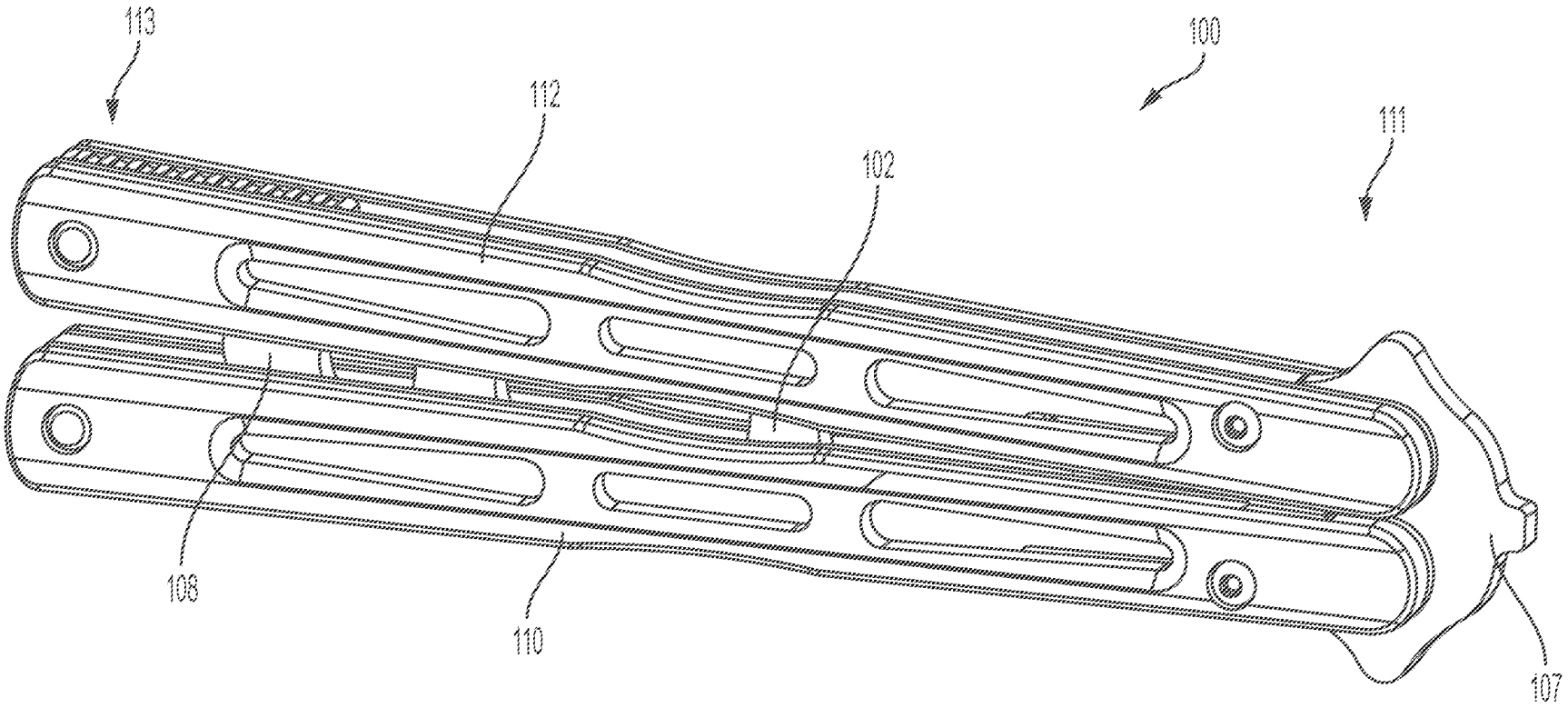
FIG. 1 is a perspective view of a butterfly knife that includes a latchless locking mechanism, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Most butterfly style knives, such as BALI-SONG® knives, include a latch that holds the two handle halves together when the knife is in either the fully closed position or the fully open position. There are several types of conventional latches for these knives, but the most common latch is defined by an elongate latch arm that is pivotally attached to the rearward, exposed end of one of the two handle halves. When the two handle halves are oriented parallel to one another, for example when the knife is fully closed or when the knife is fully open, the elongate latch arm may be pivoted about its attachment to one handle half toward the other handle half where the distal end of the latch arm engages a cooperatively shaped seat on the other handle half. Once engaged, the latch arm secures the two handle halves with the knife in either the open or closed position as the case may be.

While the elongate latch arm described above is a useful safety device, it will be appreciated that during the elaborate flipping techniques for users of the butterfly style knives, such as a BALI-SONG® knife, the two handle halves cannot be latched together, else the handles could not be manipulated relative to the blade as is required to perform the techniques. As such, the elongate latch arm can be seen by some users as an impediment to proper use of the knife for performing elaborate flipping techniques. Indeed, because some of the techniques are performed so rapidly and with such precision that there is only minimal clearance between the user's hand and arm during the technique, the elongate latch arm can get in the way and can even hit the user's hand and/or arm. In addition, the inclusion of a latch on a butterfly knife results in unequally weighted handles.

The purpose of locking the butterfly knife in the closed position is to protect the user by the handles from the blade edge. This interferes with proper flipping technique and some users remove or cut the elongate latch arm off their butterfly style knives, such as a BALI-SONG® knife. While this defeats an obvious safety mechanism, it allows the sophisticated user to perform their moves without interference from the latch arm. But even more bothersome to many users is the fact that during the flipping techniques the latch arm itself flips back and forth as the handles are rapidly manipulated and flipped. In some cases, the latch flopping around can cause damage to the latch, handle, or the blade. By removing the latch from the design, the handles will be equally weighted. However, without a latch, the butterfly knife would not be able to lock, presenting an obvious safety issue.

In view of the forgoing and other reasons, there is a need for innovative apparatuses and methods that allow users of butterfly style knives, such as a BALI-SONG® knife, to enjoy the safety afforded by the handle latch mechanisms, but without the negative aspects described above. The present disclosure defines such an apparatus. Those of skill in the art will readily recognize that while the disclosure is drafted with respect to a specific type of knife, the disclosure is not limited to knives but extends to any tool that requires movement of one structure relative to another.

Disclosed herein is a butterfly type or style knife having a latchless locking mechanism. A disclosed latchless butterfly knife, such as a latchless BALI-SONG® knife, includes a first handle half and a second handle half. This designation is somewhat arbitrary and is meant to aid in describing a latchless butterfly knife, such as shown in FIG. 1. Each of the handle halves can be further divided into a left handle portion and right handle portion that are held apart to form a blade groove there between. In embodiments, the left handle portion and the right handle portion each include a liner with a pivot slot and a lock pin disposed between the left handle portion and the right handle portion. In some embodiments, the liners include through bores for positioning the lock pin. The latchless butterfly knife further includes a blade having a tang that is pivotally and slidably coupled independently to each of the handle halves with separate pivot pins. This allows for the handle halves to be separately rotated about their respective pivot pins relative to the blade, for example during the flipping and other tricks discussed above. In some embodiments, washers are disposed between the liners and the tang, for example, to facilitate smooth rotation and/or translation of the tang relative to the handle halves. The inclusion of such washers also limits the wear on the blade and/or liners that may result from extended use.

One of the unique features of the disclosed latchless butterfly knife is that the locking mechanism uses features present on both the liners and the tang to allow the blade to be locked in a closed position by simple translocation of the blade (and blade tang) relative to the liners, and therefore the handle halves. In embodiments, the tang includes a pair of tang slots disposed on either side, e.g. top and bottom of the tang, that are each configured to accept a locking pin as the blade is moved to a closed position from an open position. In embodiments, these tang slots are further configured to retain their respective lock pins to prevent the rotation of the handle half when the blade is in a locked position, for example, after the blade is moved from an unlocked to locked position. The blade can be moved from an unlocked position to this locked position by translocating the blade relative to the handle halves, providing for an elegant and well-balanced design. By way of example, the handles/liners lock/unlock the blade by translating the stop pin into the blade tang slot by pushing the blade into/out of the handles (see, for example, FIGS. 4-8). In certain embodiments, the tang slot includes a hook portion extending at least partially over the tang slot. In embodiments, the hook portion is configured to capture the lock pin when the blade in the locked position and thereby prevent rotation of the blade from the first locked position to the open position. In certain embodiments, the pivot slots each include a biasing member, such as a spring, that biases the pivot pin between the locked position and the unlocked position, such that the blade is biased to one of these positions. In embodiments, the pivot slots include a first indentation corresponding to the locked position and a second indentation corresponding to the second unlocked position, for example to locate the pivot pins in these positions. In embodiments, the biasing member provides some force that urges or otherwise compels the pivot pin into either one of the indentations. In certain embodiments, the biasing member comprises a leaf spring integral to the liner. In some embodiments, the pivot slots comprise a channel separating the biasing members from nose portions of the liner, configured to allow the biasing members to move independently of the nose portions. When in the locked position, the stop pin is biased toward the blade and causes the handles to pinch toward each other, for example, requiring some amount of force to overcome this biasing so as to prevent the knife from unintentionally unlocking.

In certain embodiments, the liners include a jimping section configured to prevent the first handle half and the second handle half from independently sliding relative to the tang. The liner jimping (small extrusions/extensions and notches) is used to prevent relative translational motion between the two handles when locking and unlocking the knife. In some embodiments, the jimping is interdigitated between the opposing liners of the two handle halves. The jimping section can be configured as needed to the type, size, and/or style of knife.

In some embodiments, each of the left and right handle portions include an exterior sidewall coupled to the respective liners. Different decorative exterior sidewalls and different materials can thus be used to surface the knife. In embodiments, the exterior sidewall includes a handle spacing extension on a butt end of the exterior sidewall that is configured to provide space between the handle halves when in the closed position. One or more handle spacing extensions may be configured on the exterior sidewalls of the left and or right handle portions. Alternatively, the handle spacing extensions may be extensions of one or more liners. In embodiments, handle spacing extensions could be on the left and/or right handle portions in addition to, or instead of, on one or more liner. A handle spacing extension could be configured on the butt end of the sidewall or liner (near the tang of the blade) or on the distal end of the sidewall or liner (near the blade tip when in the closed position).

In embodiments, the tang includes ears oppositely disposed on the tang and configured for a user to manipulate to move the blade from the first locked position to a second unlocked position and vice versa. In embodiments, the tang includes an end bumper extending from the tang and configured for pushing the blade into the locked position from a second unlocked position.

Also disclosed is a latchless locking system that may include any of the other features disclosed herein. In embodiments, the latchless locking system includes a handle half. In embodiments, the handle half includes a left handle portion and a right handle portion held apart to form a blade groove there between. In embodiments, the left handle portion and the right handle portion each include a liner that has a pivot slot. In embodiments, the handle half includes a lock pin disposed between the left handle portion and the right handle portion. In embodiment, the latchless locking system includes a blade having a tang that is pivotally and slidably coupled to the handle half with a pivot pin. In embodiments, the tang includes a tang slot configured to accept the locking pin as the blade is moved to a closed position from an open position and a hook portion extending at least partially over the tang slot, the hook portion being configured to capture the lock pin when the blade is in the locked position and thereby prevent rotation of the blade from the locked and closed position to the open position. In embodiments, the pivot slots each include a biasing member that biases the pivot pin between the locked position and the unlocked position. In embodiments, the biasing member is a leaf spring integral to the liner. In embodiments, the liners further include a through bore for positioning the lock pin. In embodiments, a washer is disposed between the liners and the tang. In embodiments, the pivot slots include a channel separating the biasing members from nose portions of the liner, which allow the biasing members to move independently of the nose portions. In embodiments, the pivot slots include a first indentation corresponding to a locked position and a second indentation corresponding to the unlocked position.

Turning now to the figures, embodiments of the disclosed butterfly-type knife including a latchless locking mechanism will be discussed. The basic components of the knife 100 will be described first, prior to a detailed description of the latchless locking mechanism. The knife 100 includes a blade 102 that is pivotally and separately attached to two independent handle halves 110 and 112 at pivot points hidden in this view. The pivot points are at the "forward" end 111 of the handle halves 110 and 112 and the pivots are defined by pivot shafts (see FIG. 2 description below), which define a blade pivot axis. The blade 102 includes laterally opposed pivot axis bores through which the respective pivot shafts extend—the pivot axis bores are not visible in the view of FIG. 1. The opposite or rearward (or butt) end of the handle halves is identified with reference number 113. Each of the two handle halves 110 and 112 includes a blade groove between opposed sidewalls along one side of each of the handle halves 110 and 112. The blade grooves of the handle halves 110 and 112 are not readily visible in the perspective view of FIG. 1. The blade 102 includes a tang 107 and a working portion 108. In the figures shown herein the blade 102 is a shown as a blank for reference purposes, the working portion 108 can take on any configuration that fits within the blade grooves of the handle halves 110 and 112. In FIG. 1, the blade 102 is in the closed position—that is, the blade 102 is at least partially enclosed within the blade grooves of the paired handle halves 110 and 112. It will be understood that each of the handle halves 110 and 112 is independently pivotal about the individual pivot axis at which the handle halves 110 and 112 are attached to the blade 102 at the blade tang 107. As such, when the two handle halves 110 and 112 are rotated about their respective blade pivot axes by 180 degrees, the opposed edges of the blade 102 would be exposed with the blade 102 presented in an open and extended form.

Figure 2:
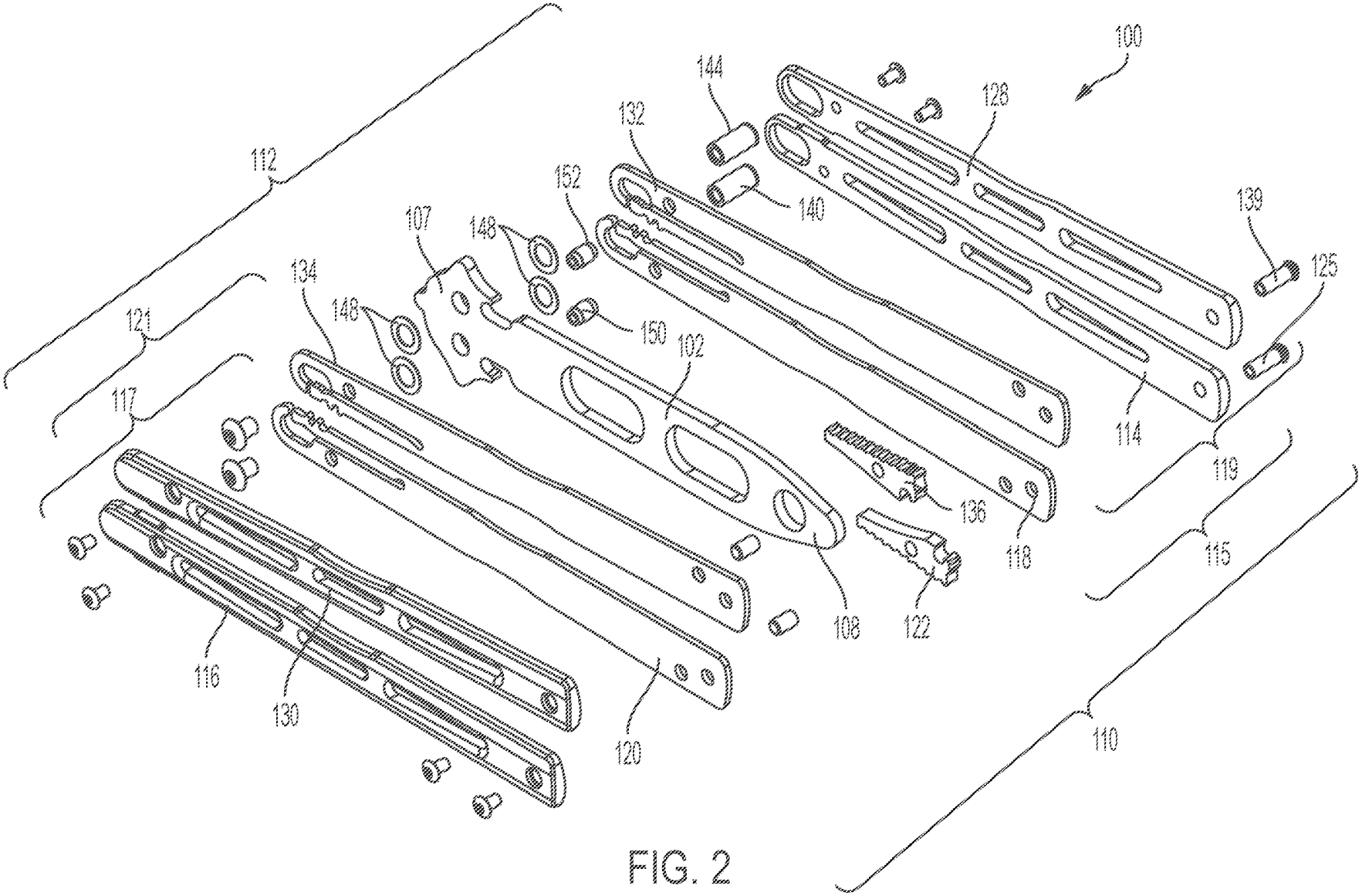
FIG. 2 is a perspective and exploded view of the knife of FIG. 1, in accordance with various embodiments.

Turning now to FIG. 2, the components of the butterfly knife, including those that make up the latchless locking mechanism, will be discussed. FIG. 2 shows an exploded view of the knife shown in FIG. 1. As shown in FIG. 2, each of the handle halves 110 and 112 is composed of two handle sections, for convenience of description termed a right handle section 115 and left handle section 117 for handle half 110 and a right handle section 119 and left handle section 121 for handle half 112. Each of the left and right handle sections 115, 117, 119, and 121 include an outer side wall, 114, 116, 128, and 130, respectively. In addition, each of the left and right handle sections 115, 117, 119, and 121 include a liner 118, 120, 132, and 134, coupled to their respective outer side wall, i.e. sidewalls 114, 116, 128, and 130.

Handle section 115 and handle section 117 are pivotally coupled to the tang 107 of the blade 102 at a pivot point around pivot shaft 140. Similarly, handle section 119 and handle section 121 are pivotally coupled to the tang 107 of the blade 102 at a pivot point around pivot shaft 144. Handle section 115 and handle section 117 are spaced apart and rigidly held together by spacer block 122 and nut 125 at the butt end, and, along with the pivot shaft 140, form the unitary structure of handle half 110, with blade groove disposed therein. Similarly, handle section 119 and handle section 121 are spaced apart and rigidly held together by spacer block 136 and nut 139 at the butt end, and, along with the pivot shaft 144, form the unitary structure of handle half 112, with blade groove disposed therein. As further shown in FIG. 2, a set of washers 148 is disposed between the tang 107 of the blade 102 and the liners 118, 120, 132, and 134 when assembled. The washers 148 help to provide for ease of rotation and/or sliding of the tang 107 of the blade 102 relative to the liners 118, 120, 132, and 134. Also shown in this view are lock pins 150 and 152, the purpose of which will become apparent. Additional fasteners are also shown in this view, which serve to couple various components of the knife together.

Figure 3:
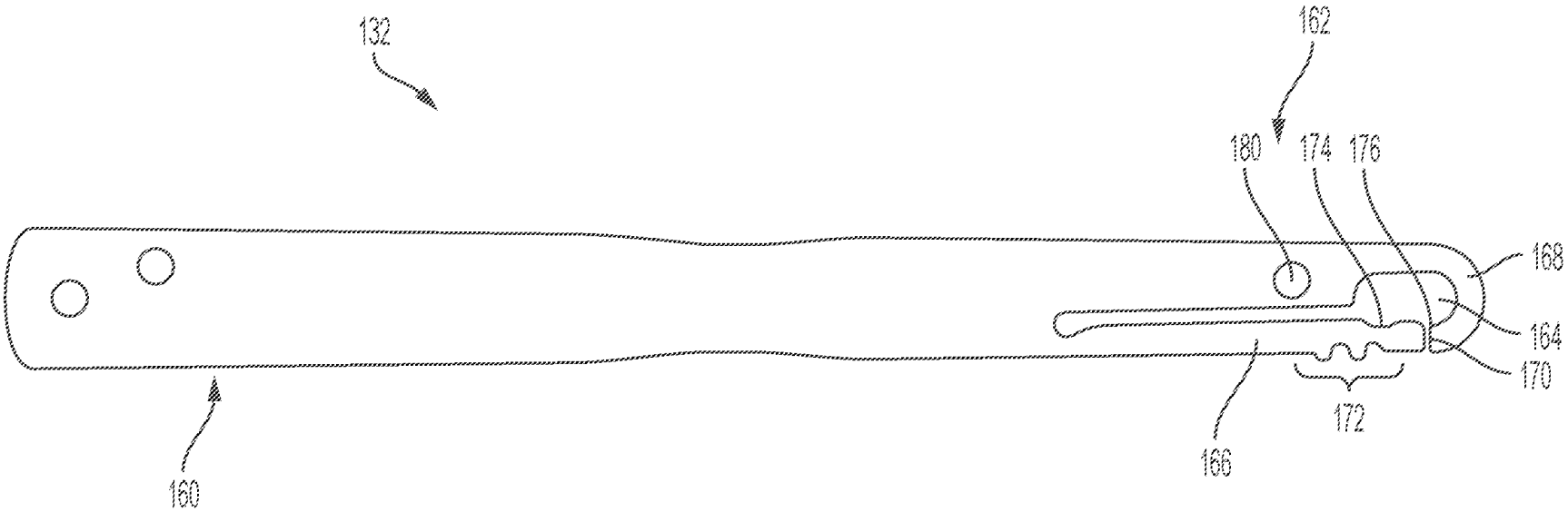
FIG. 3 is a side elevation view of a liner of the knife of FIG. 1, in accordance with various embodiments.

At the heart of the latchless locking mechanism for a butterfly knife are the liners as shown in FIG. 2 and touched on above. Turning now to FIG. 3, an exemplary liner 132 will be discussed. Although only liner 132 is discussed in the context of FIG. 3, this discussion is equally applicable to liners 118, 120, and 134. Liner 132 includes an elongate body 160 and a head portion 162. The head portion includes a pivot slot 164 that is configured to allow the pivot pin (not shown in this view) to travel therein. This view also shows the biasing member 166, which acts as leaf spring to maintain the pivot pin (and therefore the tang and blade) in either an unlocked or locked position. The biasing member 166 is separated from a nose portion 168 of the head portion 162 by a channel 170, which allows the biasing member 166 to move independent of the nose portion 168 as a pivot pin is translocated from one end of the pivot slot 164 to the other. As the pivot pin moves, the biasing member 166, biases the pivot shaft into either indent 174 in the locked position or indent 176 in the unlocked position. This movement is illustrated in greater detail below. Also shown in this view is jimping 172, which as will become more evident below, prevents opposing liners from the two handle halves from moving independent of each other relative to the tang. Further shown in FIG. 3 is location bore 180, which locates the position of one of the lock pins shown in FIG. 2.

Figure 4:
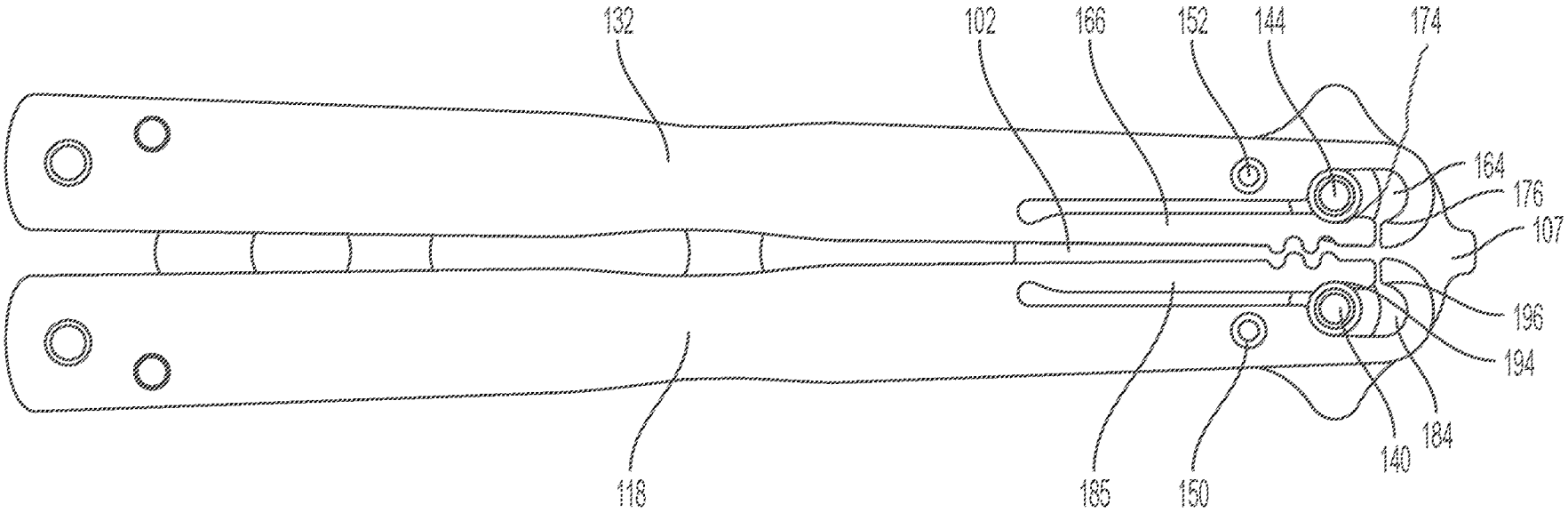
FIG. 4 is a side elevation view looking from a liner side to a blade side of a partially assembled knife of FIG. 1 with the blade in the closed and locked position, in accordance with various embodiments.
Figure 5:
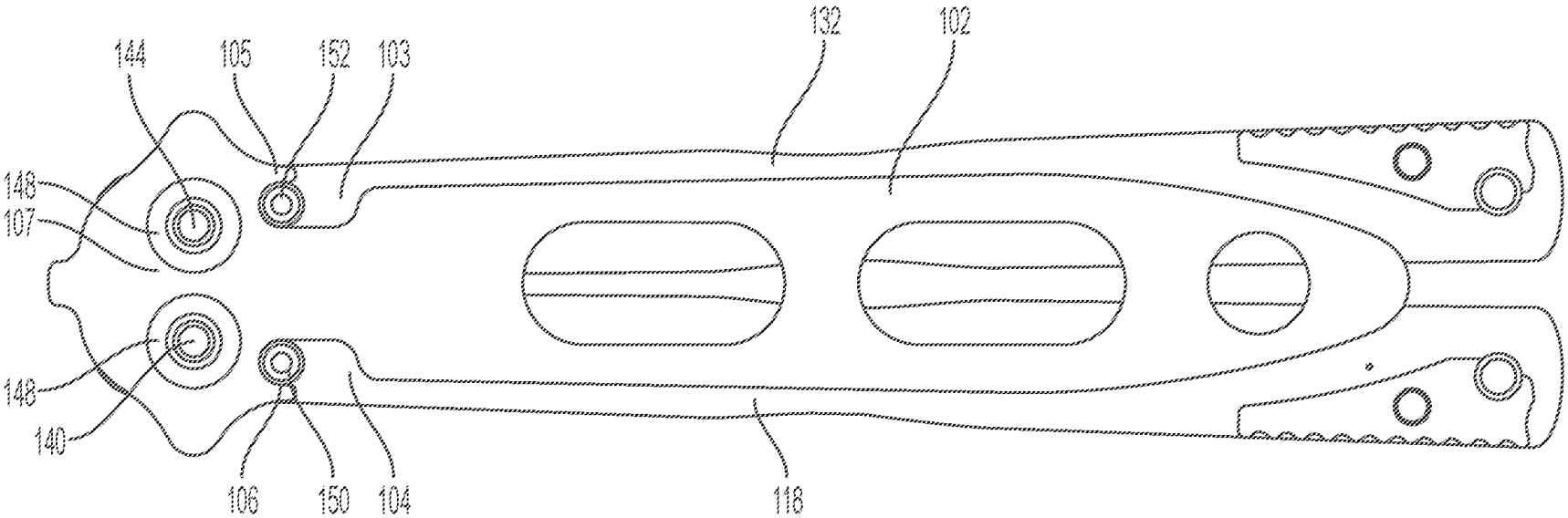
FIG. 5 is a side elevation view looking from a blade side to a liner side of a partially assembled knife of FIG. 1 with the blade in the closed but locked position, in accordance with various embodiments.
Figure 6:
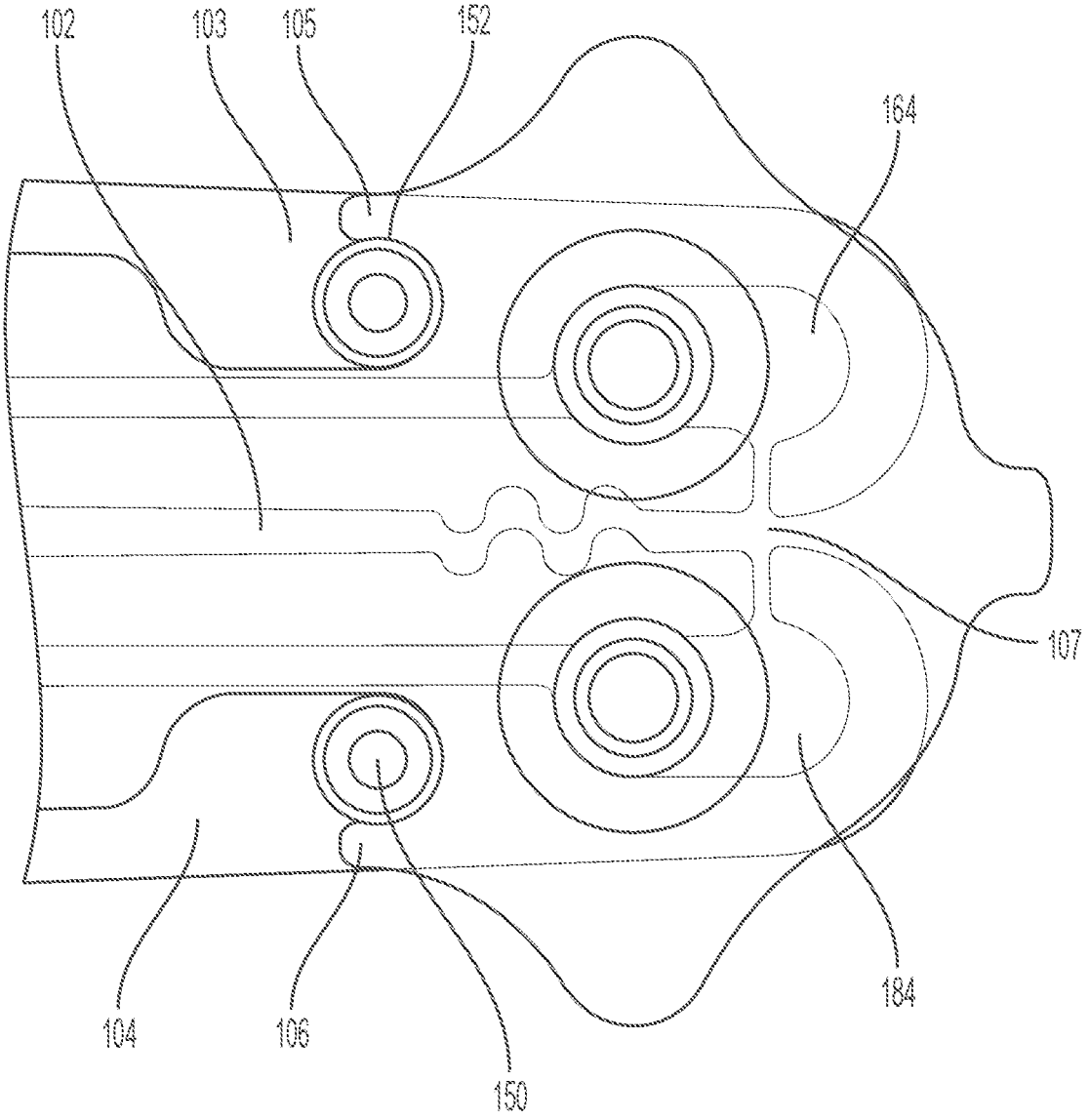
FIG. 6 is a partially transparent close up of FIG. 4 illustrating how the features of the tang and stop pin bias the handles together when in the locked and closed position, in accordance with various embodiments.
Figure 7:
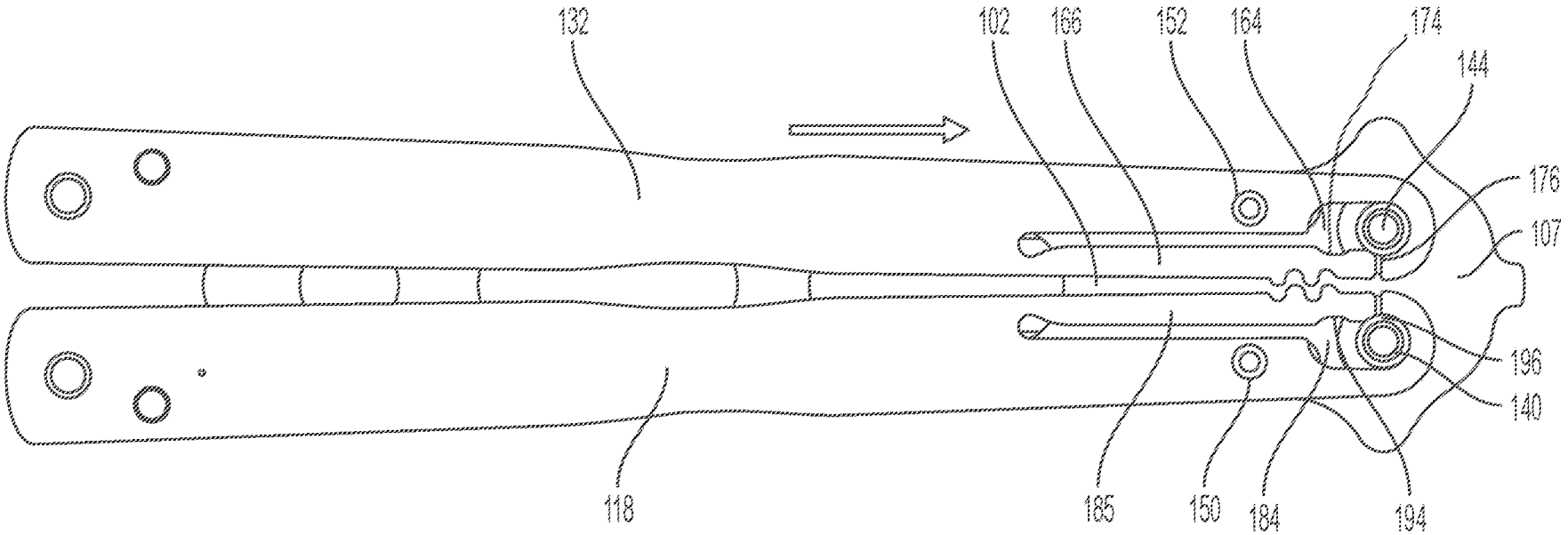
FIG. 7 is a side elevation view looking from a liner side to a blade side of a partially assembled butterfly knife of FIG. 1 with the blade in the closed but unlocked position, in accordance with various embodiments.
Figure 8:
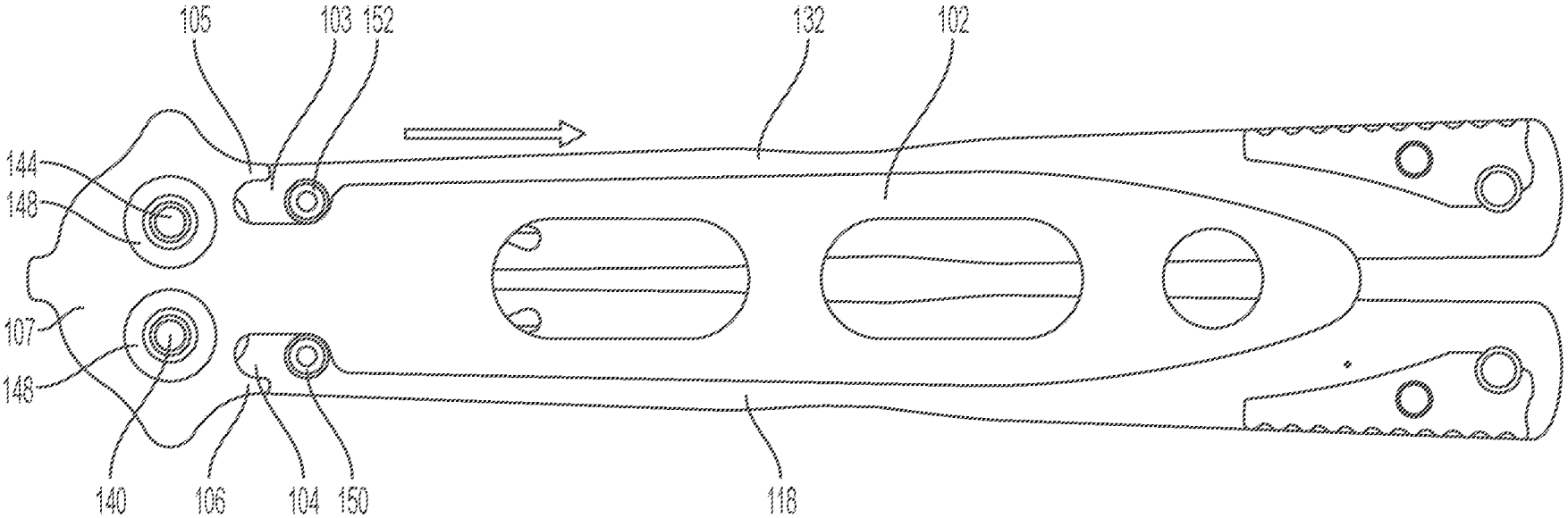
FIG. 8 is a side elevation view looking from a blade side to a liner side of a partially assembled butterfly knife of FIG. 1 with the blade in the closed and unlocked position, in accordance with various embodiments.

Turning now to now to FIGS. 4-9, details of the locking mechanism with respect to the butterfly knife 100 will now be discussed. FIGS. 4-8 show various views of a partially assembled knife, including liners 118 and 132 and blade 102. In FIGS. 4-6, the blade is in the locked closed position, while in FIGS. 7 and 8, the blade 102 is shown in the unlocked but closed position. Turning first to FIG. 4, pivot pins 140 and 144 are shown occupying indentations 194 and 174 of pivot slots 184 and 164, respectfully. The presence of the pivot pins 140 and 144 in this position corresponds to a locked position. The biasing members 166 and 185, built into the liners 118 and 132, bias the pivot pins 140 and 144 toward the unlocked and locked positions defined by indentations 176, 196 and 174, 194, respectively. Turning briefly to FIG. 5, which is identical to FIG. 4 but rotated 180°, when the pivot pins 140 and 144 are in the locked position, the tang 107 of the blade 102 is positioned such that hooks 105 and 106 of tang slots 103 and 104 engage with and retain the lock pins 150 and 152. As can be seen in this figure (and when compared to FIG. 8) that the hooks 105 and 106 prevent the liners 118 and 132 (and therefore the handle halves) from rotation about the pivot pins 140 and 144. In this position, the lock pins 150 and 152 are interfering with the blade tang 107. This causes the handles to pinch together while locked closed. Interference between the lock pins 150 and 152 and blade tang slots 103 and 104 and hooks 105 and 106 will bias the handles together when in the closed-lock position. Also shown in this view are the washers 148, which facilitate the smooth rotation and translation of the blade tang 107 relative to the liners 118 and 132. FIG. 6 provides a partially transparent view of the front end of the knife to aid in illustrating the placement of the features of the latchless locking mechanism as described for FIGS. 4 and 5. Turning to FIG. 7, if the blade 102 is translated relative to the liners 118 and 132, as indicated by the arrow, the pivot pins 140 and 144 are translocated to the indentations 196 and 176, which correspond to the unlocked position. Turning briefly to FIG. 8, which is identical to FIG. 7 but flipped 180°, with the pivot pins 140 and 144 in the unlocked position the lock pins 150 and 152 have now been translocated relative to the hooks 105 and 106. In this position, the lock pins 150 and 152 are no longer retained by the hooks 105 and 106 of the tang slots 103 and 104. In this position, the liners 118 and 132 (and therefore the handle halves) are free to rotate about the pivot pins 140 and 144. Translocation of the blade 102 relative to the liners 118 and 132 as shown by the arrow would cause the blade to return to the position as shown in FIGS. 5-7 and result in the blade being in the closed and locked position.

Figure 9:
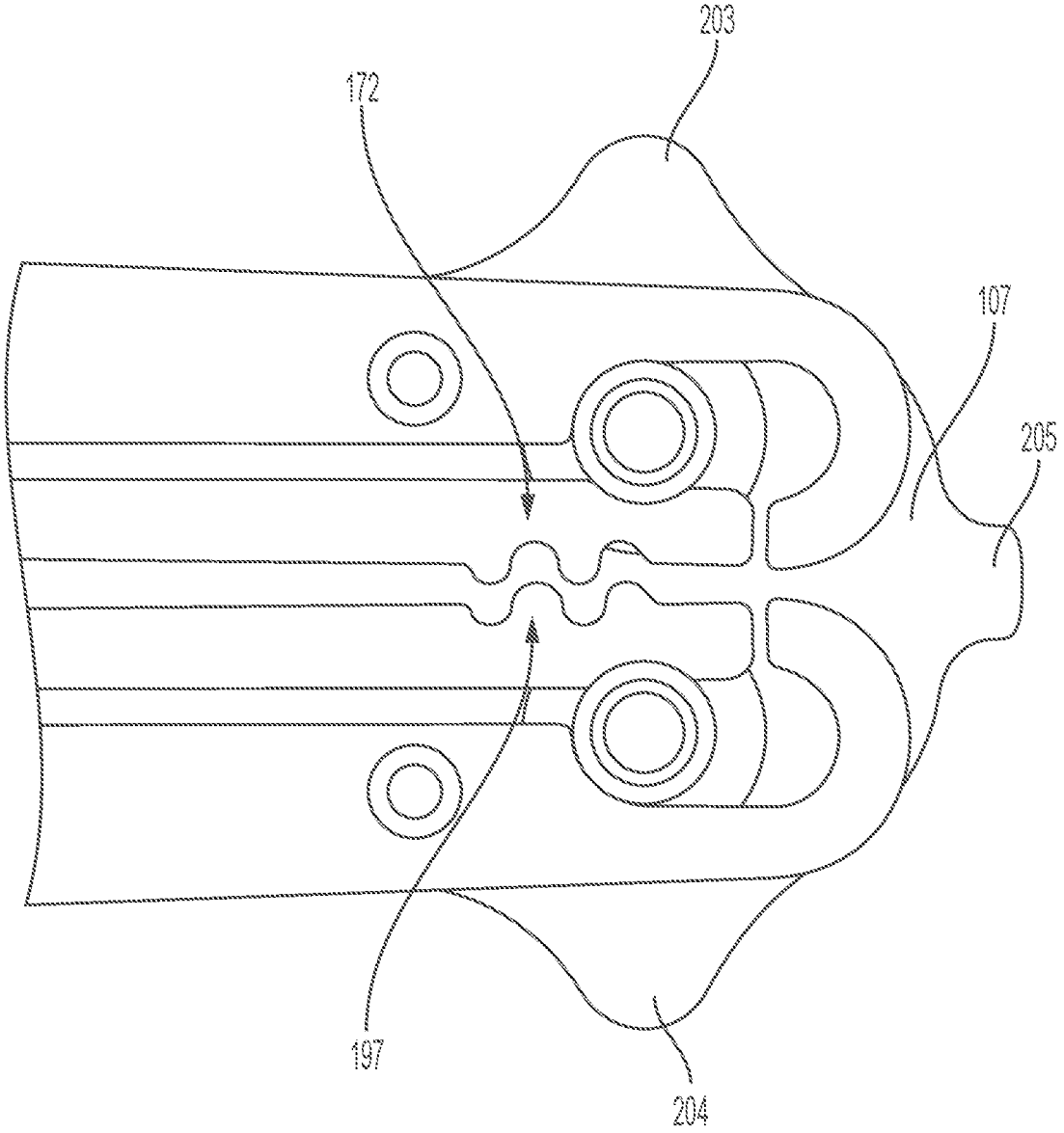
FIG. 9 is a close up of FIG. 4 illustrating jimping on two liners, in accordance with various embodiments.

Turning to FIG. 9, to prevent the handle halves from independently sliding relative to the tang 107, jimping 172 and 197 is placed within the liners 132 and 118, respectively. The interdigitated jimping 172 and 197 prevents the handles from translating relative to one another while in the closed position. The jimping 172 from one liner 132 fits within the jimping 197 in the liner 118 of the opposite handle half. Jimping location and length depend on the design/purpose of the knife. Ears 203 and 204 and end bumper 205 of tang 107 are also located in this view.

Figure 10:
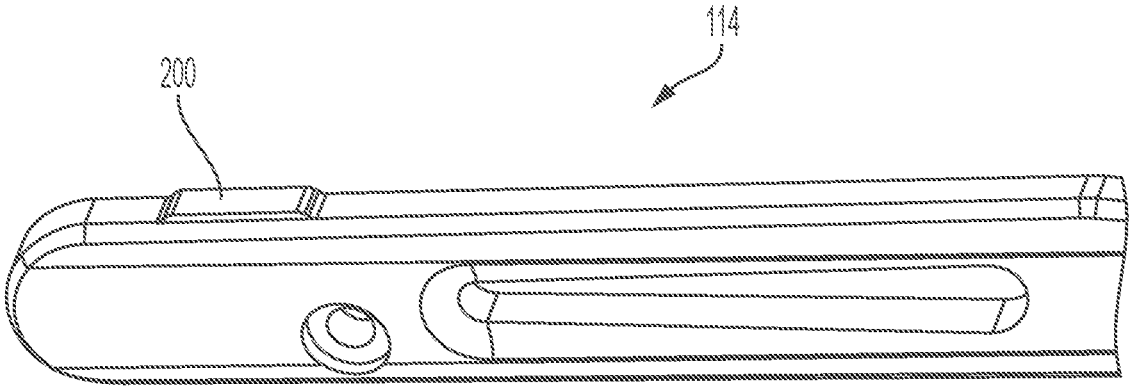
FIG. 10 is a perspective view of a butterfly knife handle facing showing a handle spacing element, in accordance with various embodiments.
Figure 11:
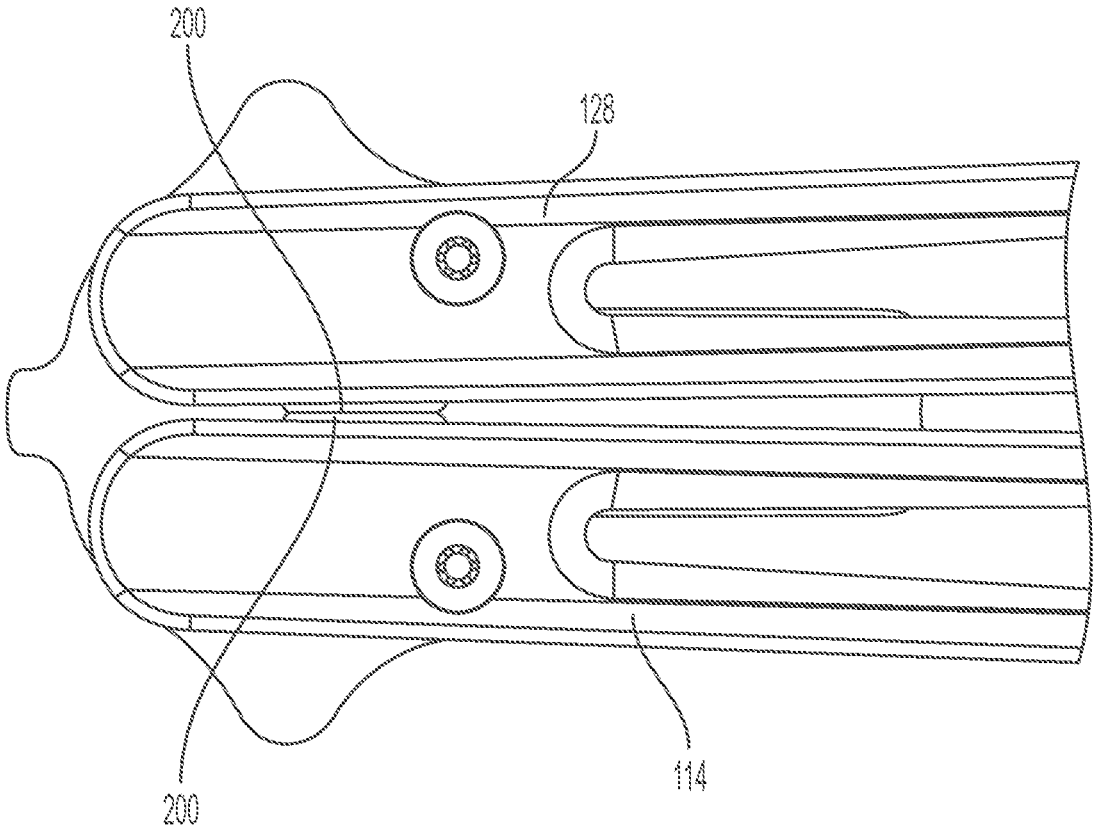
FIG. 11 is a side elevation view of two knife handle facings showing the placement of two opposing handle spacing elements, in accordance with various embodiments.
Figure 12:
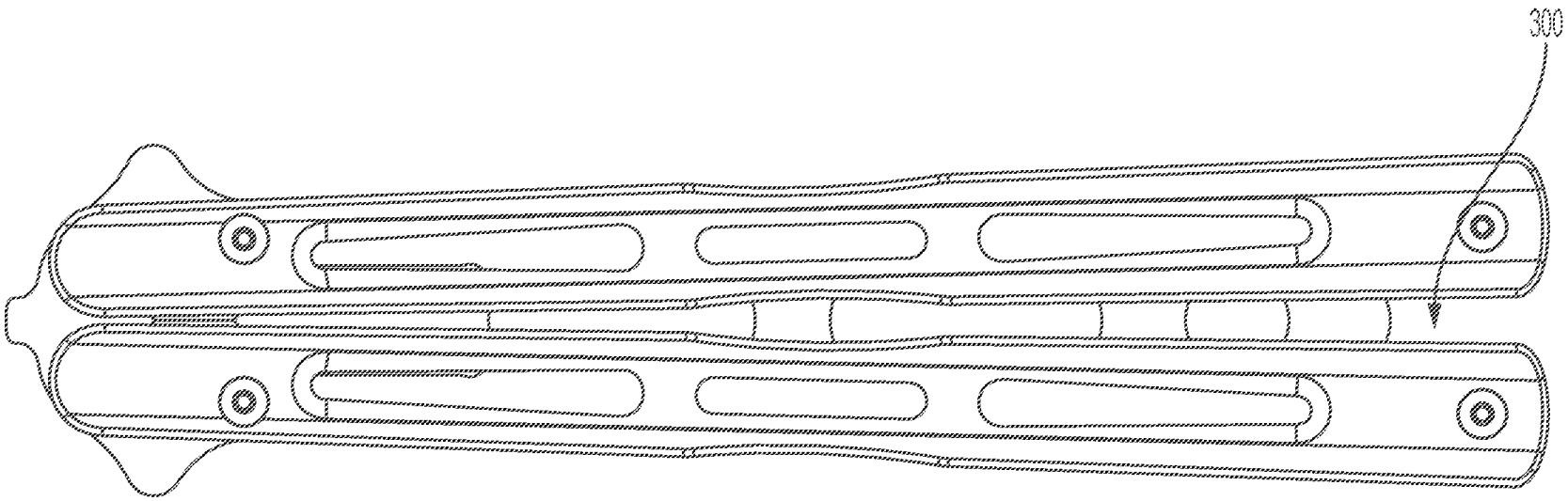
FIG. 12 is a side elevation view of a butterfly knife showing how the placement of the two opposing handle spacing elements provide for spacing of the distal ends of the handles.

Turning to FIGS. 10-12 in addition to the locking mechanism, in certain embodiments the butterfly knife includes features which provide for the spacing of the handle halves. As shown in FIG. 10, each of the outer sidewalls, as exemplified by outer sidewall 114, include a handle spacing extension 200. As shown in FIG. 11, the handle spacing extensions 200 when disposed on opposing sidewalls, as exemplified by sidewalls 114 and 128, interact with each to provide space between the handle halves when in the closed position (see FIG. 12, spacing 300). This provides clearance for keeping the user from getting pinched. It also reduces the amount of wear when the handles hit with flipping.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A knife, comprising:

a first handle half comprising:

a first left handle portion and a first right handle portion held apart to form a first blade groove between the first left handle portion and the first right handle portion, the first left handle portion including a first liner having a first pivot slot and the first right handle portion including a second liner having a second pivot slot; and a first lock pin disposed between the first left handle portion and the first right handle portion;

a second handle half comprising:

a second left handle portion and a second right handle portion held apart to form a second blade groove between the second left handle portion and the second right handle portion, the second left handle portion including a third liner having a third pivot slot and the second right handle portion including a fourth liner having a fourth pivot slot; and a second lock pin disposed between the second left handle portion and the second right handle portion, and a blade having a tang, the tang being pivotally and slidably coupled to the first handle half with a first pivot pin and pivotally and slidably coupled to the second handle half with a second pivot pin, wherein the tang comprises a first tang slot configured to retain the first lock pin to prevent rotation of the first handle half relative to the blade when the blade is in a first locked position and a second tang slot configured to retain the second lock pin to prevent rotation of the second handle half relative to the blade when the blade is in the first locked position.

2. The knife of claim 1, further comprising a first hook portion partially defining and extending at least partially over the first tang slot, wherein the first hook portion is configured to capture the first lock pin when the blade is in the first locked position and wherein the second tang slot comprises a second hook portion partially defining and extending at least partially over the second tang slot, wherein the second hook portion is configured to capture the second lock pin when the blade is in the first locked position.

3. The knife of claim 1, where each pivot slot comprises a biasing member that biases the first and second pivot pins between the first locked position and a second unlocked position.

4. The knife of claim 3, wherein each biasing member comprises a leaf spring integral to the liner.

5. The knife of claim 3, wherein each pivot slot comprises a channel separating each biasing member from each nose portion of each liner allowing the biasing members to move independently of the nose portions.

6. The knife of claim 3, wherein the pivot slots comprises a first indentation corresponding to the first locked position and a second indentation corresponding to the second unlocked position.

7. The knife of claim 1, wherein each liner further comprises a through bore for positioning the first or second lock pin.

8. The knife of claim 1, wherein each of the first and second left handle portions and the first and second right handle portions comprises one of a plurality of exterior sidewalls, wherein each exterior sidewall is coupled to one of the first, second, third, or fourth liner.

9. The knife of claim 8, wherein at least one exterior sidewall or liner comprises a handle spacing extension configured to provide space between the first handle half and the second handle half when in the first locked position.

10. The knife of claim 1, further comprising at least one washer disposed between each liner and the tang.

11. The knife of claim 1, wherein each liner further comprises a jimping section configured to prevent the first handle half and the second handle half from independently sliding relative to the tang.

12. The knife of claim 11, wherein each jimping section is interdigitated.

13. The knife of claim 1, further comprising ears oppositely disposed on the tang and configured for a user to manipulate to move the blade from the first locked position to a second unlocked position.

14. The knife of claim 1, wherein the tang comprises an end bumper extending from the tang configured for pushing the blade into the first locked position from a second unlocked position.

15. A locking system, comprising:

a first handle half and a second handle half, the first handle half comprising:

a left handle portion and a right handle portion held apart to form a blade groove between the left handle portion and the right handle portion, wherein the left handle portion and the right handle portion each includes a liner comprising a pivot slot; and a first lock pin disposed between the left handle portion and the right handle portion;

a blade having a tang, the tang being pivotally and slidably coupled to the handle half with a pivot pin wherein the tang comprises a tang slot and a hook portion extending over the tang slot, wherein the hook portion is configured to capture the first lock pin when the blade is in a first locked position and thereby prevent rotation of the blade from the first locked position, wherein the pivot slots each comprise a biasing member that biases the pivot pin along the pivot slot.

16. The locking system of claim 15, wherein the pivot slots comprise a first indentation corresponding to the first locked position and a second indentation corresponding to a second unlocked position.

17. The locking system of claim 15, wherein each biasing member comprises a leaf spring integral to each liner.

18. The locking system of claim 15, wherein each liner further comprises a through bore for positioning the first lock pin.

19. The locking system of claim 15, further comprising at least one washer disposed between each liner and the tang.

20. The locking system of claim 15, wherein the pivot slots comprise a channel separating each biasing member from each nose portion of each liner, configured to allow the biasing members to move independently of the nose portions.

* * * * *